US009202449B2

(12) United States Patent
Hummel

(10) Patent No.: US 9,202,449 B2
(45) Date of Patent: Dec. 1, 2015

(54) VACUUM TUBE AMPLIFICATION UNIT

(71) Applicant: Markus Oliver Hummel, San Jose, CA (US)

(72) Inventor: Markus Oliver Hummel, San Jose, CA (US)

( * ) Notice: Subject to any disclaimer, the term of this patent is extended or adjusted under 35 U.S.C. 154(b) by 0 days.

(21) Appl. No.: 14/629,704

(22) Filed: Feb. 24, 2015

(65) Prior Publication Data

US 2015/0170627 A1 Jun. 18, 2015

Related U.S. Application Data

(63) Continuation-in-part of application No. 14/073,689, filed on Nov. 6, 2013, now Pat. No. 9,012,759.

(60) Provisional application No. 61/946,463, filed on Feb. 28, 2014, provisional application No. 61/724,106, filed on Nov. 8, 2012.

(51) Int. Cl.

| | |
|---|---|
| ***G10H 1/02*** | (2006.01) |
| ***G10H 1/08*** | (2006.01) |
| ***G10H 1/00*** | (2006.01) |
| ***G10H 1/32*** | (2006.01) |
| ***G10H 1/34*** | (2006.01) |
| ***G10H 3/18*** | (2006.01) |

(52) U.S. Cl.

CPC ..... *G10H 1/08* (2013.01); *G10H 1/0091* (2013.01); *G10H 1/32* (2013.01); *G10H 1/342* (2013.01); *G10H 3/186* (2013.01)

(58) Field of Classification Search

CPC ..... G10H 3/187; G10H 1/0091; G10H 3/186; G10H 2210/311; G10H 2210/265; G10H 2210/315; G10H 3/181; H01J 25/04; H01J 25/76; H01J 21/02; H01J 25/02; H01J 25/74; H01J 2893/0029; H01J 25/36; H01J 31/495; H01J 21/00; H01J 31/44

See application file for complete search history.

(56) References Cited

U.S. PATENT DOCUMENTS

| | | | | |
|---|---|---|---|---|
| 3,953,808 | A * | 4/1976 | Clark | H03F 1/3205 315/52 |
| 6,881,891 | B1 * | 4/2005 | Limacher | G10H 3/187 84/662 |
| 7,583,141 | B1 * | 9/2009 | Chung | H03F 3/181 330/192 |
| 8,542,848 | B1 * | 9/2013 | Krutsick | G10H 3/187 330/127 |
| 2003/0179893 | A1 * | 9/2003 | Smith | H03F 3/181 381/120 |
| 2011/0043278 | A1 * | 2/2011 | Adams | H03F 1/307 330/69 |
| 2011/0146480 | A1 * | 6/2011 | Robertson | G10H 1/361 84/735 |
| 2011/0170716 | A1 * | 7/2011 | Stevens | H03F 1/0211 381/120 |
| 2011/0219942 | A1 * | 9/2011 | Robertson | G10H 3/186 84/735 |
| 2013/0027131 | A1 * | 1/2013 | Lee | H03F 3/181 330/127 |
| 2013/0136278 | A1 * | 5/2013 | Quilter | H03F 3/2173 381/118 |

(Continued)

*Primary Examiner* — Marlon Fletcher

(57) ABSTRACT

A vacuum tube amplification unit for use with electric instruments that allows for reduced or eliminated signal loss before the electrical signal of the instrument is amplified. The vacuum tube amplification unit includes an amplifier cartridge having an amplification circuit. The amplification cartridge is attached to and electrically connected to an instrument through a cartridge receiver. A pre-amp assembly of the amplification circuit provides a first stage of amplification, while an at least one vacuum tube provides a second stage of amplification. A power supply provides current to amplify the electrical signal of the instrument and a gain control allows for adjusting the magnitude of amplification. The amplification circuit may further include an integrated speaker, a signal converter, a transmitter, and a device terminal. Additionally, the amplifier cartridge may further include a device dock for attaching an electronic device.

18 Claims, 18 Drawing Sheets

(56) References Cited

U.S. PATENT DOCUMENTS

2014/0123837 A1* 5/2014 Hummel ..... G10H 1/342 84/622
2015/0170627 A1* 6/2015 Hummel ..... G10H 1/08 84/659
2015/0179158 A1* 6/2015 Hummel ..... G10H 3/00 84/626

* cited by examiner

VACUUM TUBE AMPLIFICATION UNIT

The current application claims benefit of the U.S. Provisional Patent application Ser. No. 61/946,463 filed on Feb. 28, 2014, and is a continuation in part of U.S. Utility Patent application Ser. No. 14/073,689 filed Nov. 6, 2013 which claims benefit of the U.S. Provisional Patent Application Ser. No. 61/724,106 filed Nov. 8, 2012.

FIELD OF THE INVENTION

The present invention relates generally to instrument tone effects. More specifically, the present invention integrates vacuum tubes into the body of an electric instrument in order to reduce signal loss before the electronic signal of an electric instrument is amplified.

BACKGROUND OF THE INVENTION

In the music industry, it has often been desirable to alter the sound produced from a musical instrument using sound effects. Sound effects were originally produced using techniques such as manipulating reel-to-reel tape after recording or through microphone placement during recording. As such, early sound effects were limited to in studio productions. The ability for individual musicians to manipulate instrument sounds in-home became available with the emergence of sound effects modules. Sound effects modules are electronic devices that allow musicians to manipulate the sound produced from an electric or electronic instrument. Earlier standalone sound effects modules were impractical as the equipment was both bulky and costly. Thus, the first practical sound effects modules to be used regularly outside of the studio were those built into amplifiers using vacuum tubes. With the emergence of the electronic transistor, sound amplification circuitry was able to be even further condensed into small, portable containers commonly referred to as stompbox units. Stompbox units can be designed to produce one or more effects and typically provide a number of controls for adjusting the extent to which the sound of the instrument is manipulated.

While sound effects modules are used with many different types of musical instruments, sound effects modules are most notably used in conjunction with electric guitars in the form of stompboxes. One issue with the use of stompboxes with electric guitars is cable signal loss, which is due, at least in part, to the length of the guitar cable that is used between the guitar and the stompboxes. The cable signal loss across the guitar cable between where the electronic signal of the guitar is generated to where the sound effect is applied results in a loss in tone, which is undesirable to most musicians. Ideally, tone effects are applied as close to the signal generation as possible in order to reduce the amount of signal loss that occurs before the effect is applied. Another issue associated with stompboxes is their accessibility. Stompboxes are typically either placed at the feet of the user or mounted together on a rack. Thus, in order for a musician to adjust the effects controls they must do so with their feet or be within an arm's reach of the rack. Resultantly, effects controls are typically adjusted before a set or an individual song and are not altered throughout.

Therefore it is an object of the present invention to provide a vacuum tube amplification unit that is integrated into the body of an electric instrument for easy access and manipulation of controls and reduction in signal loss before applied effects. A cartridge receiver is integrated into the body of the instrument, while an amplifier cartridge having an amplification circuit is attached to the instrument via the cartridge receiver. Signal loss between signal generation and the applied sound effect is reduced or altogether eliminated as the cartridge receiver is mounted directly onto the electric instrument, thus reducing the length of wire that the generated electronic signal must traverse in order to reach the amplification circuit. Together, the cartridge receiver and the amplifier cartridge provide electronic connections between the electric instrument and the amplification circuit. The amplification circuit includes a pre-amp assembly and an at least one vacuum tube for amplifying the electronic signal of the electric instrument, as well as a gain control for adjusting the extent to which the amplitude of the electronic signal is increased. The gain control is connected to the amplification cartridge, such that the gain control is within a hand's reach while the electric instrument is being played, thus giving the musician much greater control over the sound of his or her electric instrument. The gain control can be used to overdrive the at least one vacuum tube to generate a distorted sound. Attempts have been made to re-produce the original tube-driven overdrive sound using modern day integrated circuit boards with little success. The present invention allows for the true tube-driven overdrive sound in a footprint that is able to fit directly into an electric instrument.

DETAIL DESCRIPTIONS OF THE INVENTION

All illustrations of the drawings are for the purpose of describing selected versions of the present invention and are not intended to limit the scope of the present invention.

The present invention is a vacuum tube amplification unit for use with electric instruments that allows for reduced or eliminated signal loss before the electronic signal of an electric instrument 5 is amplified. While the present invention is intended for use with electric guitars, the vacuum tube amplification unit can be used with any other electric instrument. In the preferred embodiment of the present invention, the vacuum tube amplification unit is designed to be retrofitted to an existing instrument; however, the vacuum tube amplification unit may be integrated into new instruments at the time of manufacture if so desired.

Figure 1:
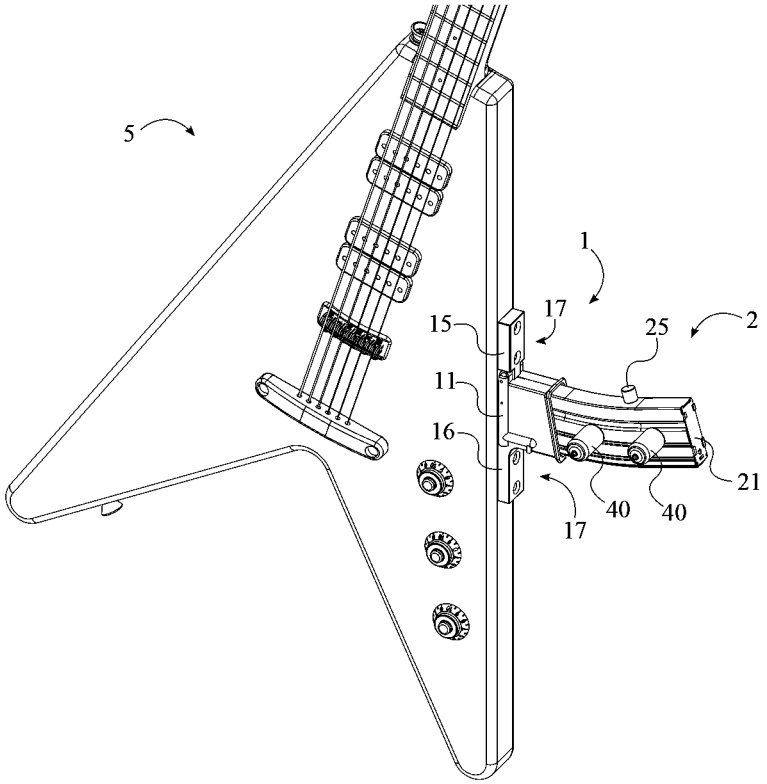
FIG. 1 is a perspective view of the present invention retrofitted onto an electric guitar.

The vacuum tube amplification unit comprises an amplification circuit 4, an amplifier cartridge 2, and a cartridge receiver 1. The cartridge receiver 1 is attached to the desired instrument and serves as a docking station for the amplifier cartridge 2, as shown in FIG. 1. The amplification circuit 4 is substantially positioned within the amplifier cartridge 2 and allows the user to readily manipulate the electrical signal of the electric instrument 5. Signal loss between where the electrical signal is generated and where the sound effect is applied is significantly reduced as a result of the amplification circuit 4 being closely wired to where the electrical signal is generated within the electric instrument 5. The amplifier cartridge 2 is removably attached to the cartridge receiver 1 such that the amplifier cartridge 2 can be removed for maintenance or replaced. In the preferred embodiment of the present invention, the cartridge receiver 1 is mounted externally on the electric instrument 5; however, it is also possible for the cartridge receiver 1 to be mounted to the electric instrument 5 internally.

Figure 3:
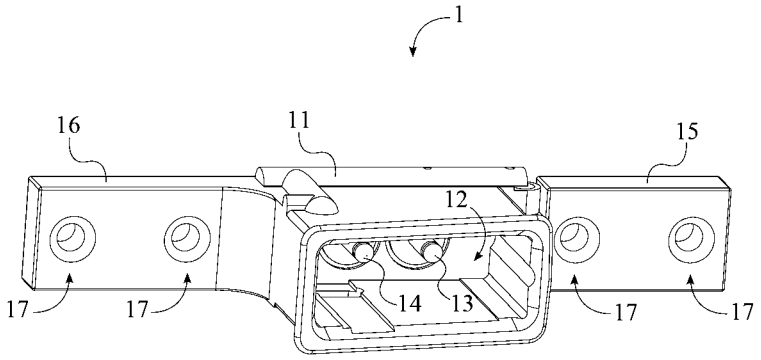
FIG. 3 is a perspective view of the cartridge receiver showing a receiving volume for accepting the amplifier cartridge.
Figure 5:
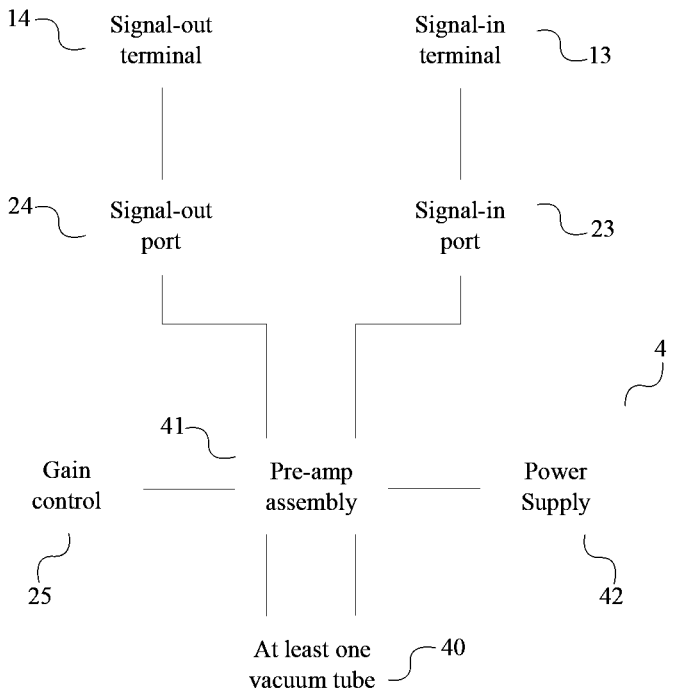
FIG. 5 is a diagram depicting the electrical connections of the cartridge receiver and an amplification circuit supported by the amplifier cartridge.

In reference to FIG. 3, the cartridge receiver 1 comprises a receiver body 11, a receiving volume 12, a signal-in terminal 13, a signal-out terminal 14, a first flange 15, a second flange 16, and a plurality of holes 17. The receiver body 11 is the central structure of the cartridge receiver 1 and defines the general shape of the cartridge receiver 1. The receiving volume 12 is positioned into the receiver body 11 and is the empty space into which the amplifier cartridge 2 is positioned when the amplifier cartridge 2 is attached to the cartridge receiver 1. Both the signal-in terminal 13 and the signal-out terminal 14 are connected to the receiver body 11 and positioned adjacent to each other within the receiving volume 12. The signal-in terminal 13 and the signal-out terminal 14 are electrically connected to an electronics circuit of the electric instrument 5 in order to receive the electrical signal of the guitar and output an amplified signal through the amplifier cartridge 2. The cartridge receiver 1 is electrically connected to the amplifier cartridge 2 through the signal-in terminal 13 and the signal-out terminal 14, as depicted in FIG. 5.

The first flange 15, the second flange 16, and the plurality of holes 17 provide a means of connection between the electric instrument 5 and the cartridge receiver 1. The first flange 15 and the second flange 16 are adjacently connected to the receiver body 11, while the plurality of holes 17 traverses through both the first flange 15 and the second flange 16. Screws are inserted through each of the plurality of holes 17 and threaded into screw holes drilled into the electric instrument 5 in order to connect the cartridge receiver 1 to the electric instrument 5. Alternatively, the screws can be threaded directly into the surface of the electric instrument 5. Additional holes are drilled through the electric instrument 5 adjacent to the receiver body 11 in order to allow electrical wire to be connected to the signal-in terminal 13 and the signal-out terminal 14.

In further reference to FIG. 3, the first flange 15 and the second flange 16 are positioned on the receiver body 11 opposite the receiving volume 12. In this way, the first flange 15, the second flange 16, and the top of the receiver body 11 rest flush against the surface of the electric instrument 5, while the receiving volume 12 is directed away from the electric instrument 5, such that the amplifier cartridge 2 can be attached to the cartridge receiver 1. The first flange 15 and the second flange 16 are positioned opposite each other across the receiver body 11 in order to securely hold the cartridge receiver 1 flush against the surface of the electric instrument 5. It is also possible for the cartridge receiver 1 to be connected to the electric instrument 5 in any other way.

Figure 2:
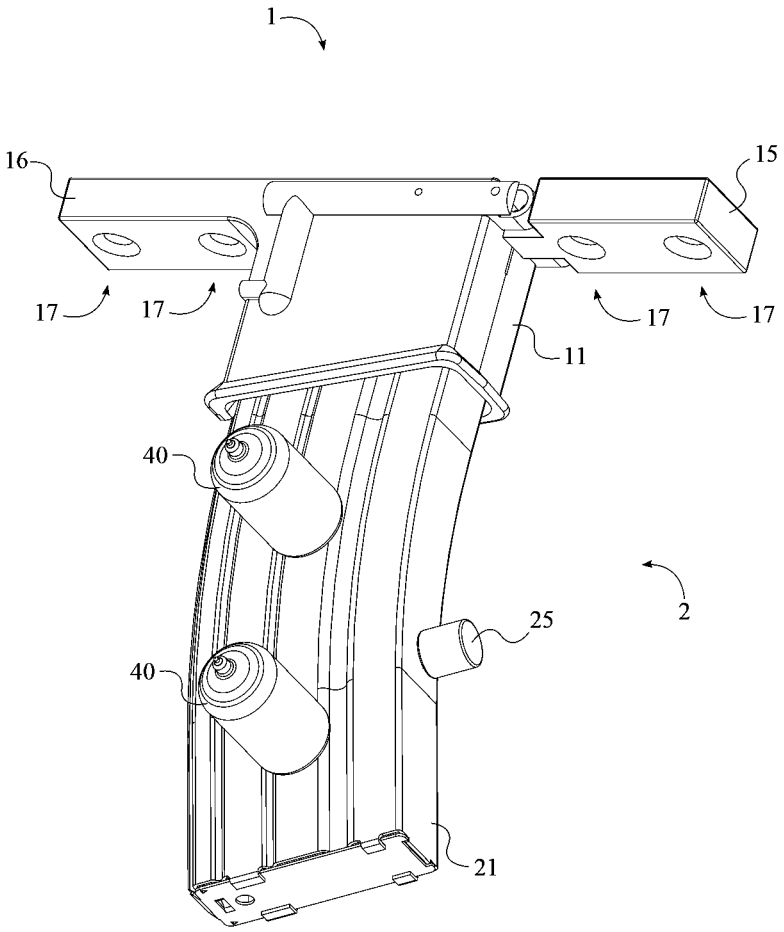
FIG. 2 is a perspective view of an amplifier cartridge positioned into a cartridge receiver, wherein an at least one vacuum tube is positioned into the amplifier cartridge.
Figure 4:
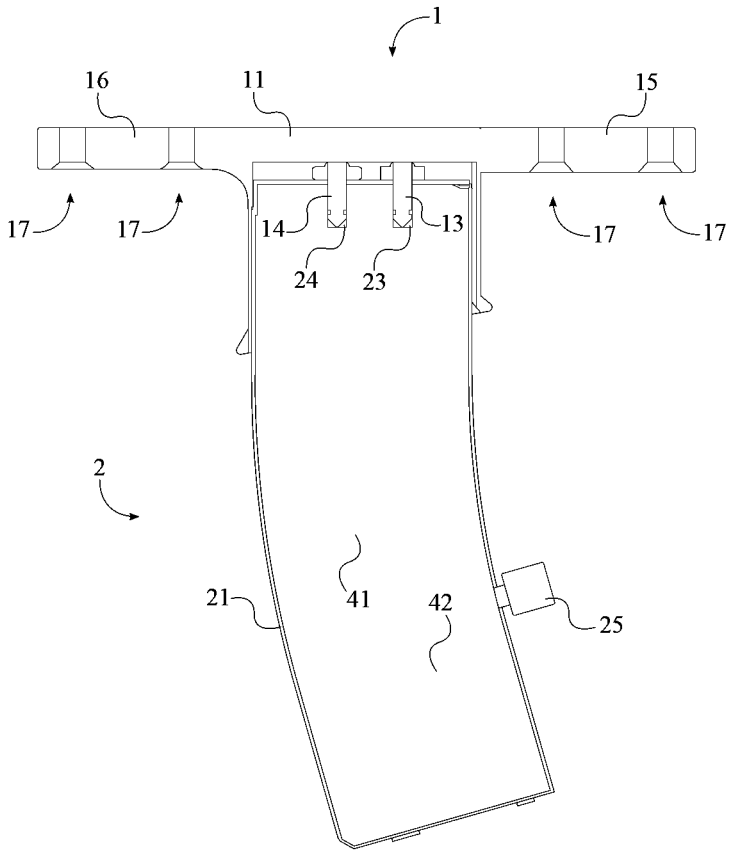
FIG. 4 is a front sectional view of the amplifier cartridge positioned within the cartridge receiver, showing a pre-amp assembly and a power source positioned within the amplifier cartridge.

In reference to FIG. 2 and FIG. 4, the amplifier cartridge 2 comprises a cartridge casing 21, a signal-in port 23, a signal-out port 24, and a gain control 25. The cartridge casing 21 is a generally thin-walled structure that provides a housing for the amplification circuit 4, as well as a mounting frame for the signal-in port 23, the signal-out port 24, and the gain control 25. The amplification circuit 4 is substantially positioned within the cartridge casing 21 and provides the various electrical components and wiring required to amplify the electrical signal of the electric instrument 5. The signal-in port 23 and the signal-out port 24 are positioned adjacent to each other through the top side of the cartridge casing 21 and are both connected to the cartridge casing 21. The amplifier cartridge 2 is electrically connected to the cartridge receiver 1 through the signal-in port 23 and the signal-out port 24. Additionally, the signal-in port 23 and the signal-out port 24 are electrically connected to the amplification circuit 4.

In further reference to FIG. 2 and FIG. 4, when the amplifier cartridge 2 is attached to the cartridge receiver 1, the top end of the cartridge casing 21 is positioned into the receiving volume 12 of the cartridge receiver 1. As the cartridge casing 21 is inserted into the receiving volume 12, the signal-in terminal 13 engages the signal-in port 23, such that the signal-in terminal 13 is positioned into the signal-in port 23. Similarly, the signal-out terminal 14 engages the signal-out port 24, such that the signal-out terminal 14 is positioned into the signal-out port 24. When the signal-in terminal 13 is positioned into the signal-in port 23, the signal-in terminal 13 is electrically connected to the signal-in port 23 as depicted in FIG. 5, thus allowing the electrical signal of the electric instrument 5 to be passed from the electronics circuit, through the amplification circuit 4. Likewise, when the signal-out terminal 14 is positioned into the signal-out port 24, the signal-out terminal 14 is electrically connected to the signal-out port 24 as depicted in FIG. 5, thus allowing the amplified electrical signal to exit the amplification circuit 4 and re-enter the electronics circuit.

Figure 14:
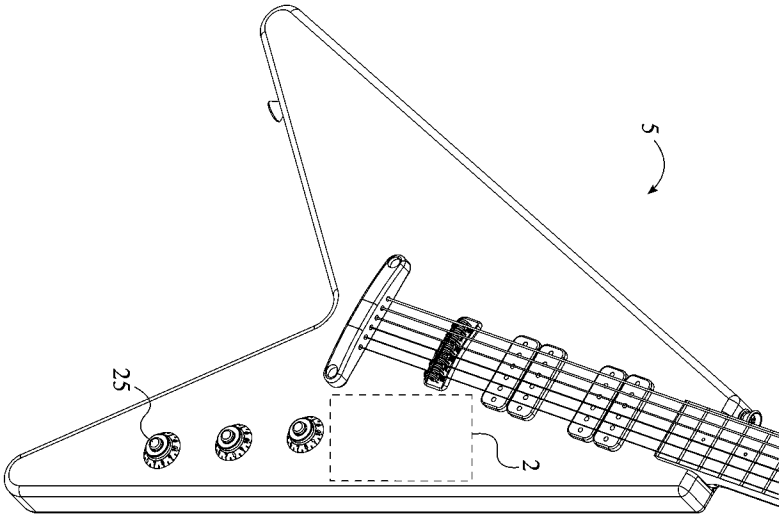
FIG. 14 is a perspective of the present invention, wherein the at least one vacuum tube is positioned within the cartridge casing, and the amplifier cartridge is positioned within the electric instrument.

In reference to FIG. 14, when the vacuum tube amplification unit 4 is manufactured directly into the electric instrument 5, the amplifier cartridge 2 is positioned within the electric instrument 5 and the cartridge receiver 1 is not used.

The electronics circuit of the electric instrument 5 is electrically connected to the amplification circuit 4 through the signal-in port 23 and the signal-out port 24, such that the electrical signal generated through the electronics circuit can be passed through the amplification circuit 4 in order to amplify the electrical signal.

Figure 15:
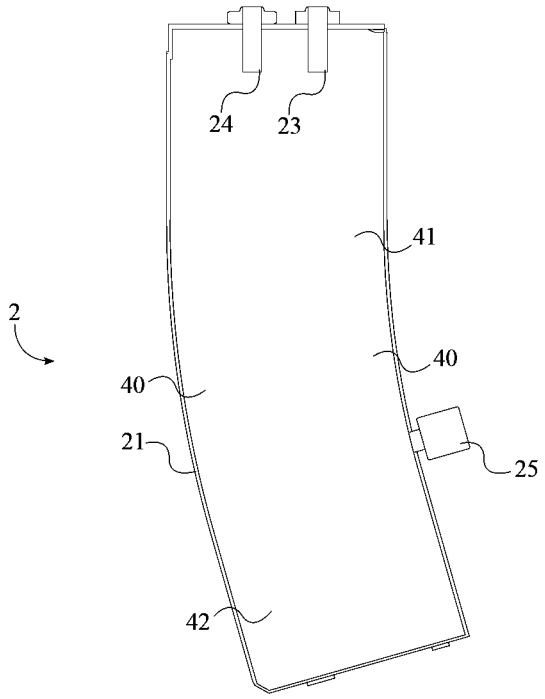
FIG. 15 is a front sectional view of the amplifier cartridge, wherein the at least one vacuum tube is positioned within the amplifier cartridge.

In reference to FIG. 5, the amplification circuit 4 comprises an at least one vacuum tube 40, a pre-amp assembly 41, and a power source 42. The at least one vacuum tube 40 is positioned into the cartridge casing 21, as shown in FIG. 2, while the pre-amp assembly 41 and the power source 42 are fully positioned within the cartridge casing 21, as shown in FIG. 4. Alternatively, the at least one vacuum tube 40 may also be fully positioned within the cartridge casing 21, as shown in FIG. 15. The pre-amp assembly 41 and the at least one vacuum tube 40 are electrically connected to each other in order to fully amplify the electrical signal of the electric instrument 5, such that the electrical signal can drive a speaker. The pre-amp assembly 41 provides an initial amplification stage, while the at least one vacuum tube 40 provides a final amplification stage. As such, the pre-amp assembly 41 is electrically connected to the signal-in port 23 to receive an initial electrical signal, while the at least one vacuum tube 40 is electrically connected to the signal-out port 24 to transmit an amplified electrical signal. The pre-amp assembly 41 provides electronic components for preparing the electronic signals received from the electric instrument 5 for further amplification by the at least one vacuum tube 40, such as resistors, transistors, capacitors, and transducers.

The pre-amp assembly 41 is electrically connected to the power source 42, such that the power source 42 supplies current to the electronic components of the pre-amp assembly 41. The power source 42 is ideally a battery, either rechargeable or non-rechargeable, and can use any known type of battery technology, such as lithium-ion technology, nickel-cadmium technology, etc. If the power source 42 is a rechargeable battery, then a charging port may also be integrated into the cartridge casing 21, such that the power source 42 does not need to be removed for recharging. If the power source 42 is a non-rechargeable battery, then an access panel may be integrated into the cartridge casing 21 in order to allow the power source 42 to be removed and replaced. If the power source 42 is not a battery, then the cartridge casing 21 may provide a charging port for attaching a power cord between the power source 42 and a power supply such as an outlet. The amplification circuit 4 may further comprise a power switch connected to the cartridge casing 21 for toggling the power source 42 on and off.

The extent to which the power or amplitude of the electrical signal from the electric instrument 5 is increased can be adjusted through the gain control 25. As such, the gain control 25 is electrically connected to the pre-amp assembly 41, as depicted in FIG. 5. The gain control 25 is rotatably connected to the cartridge casing 21 and is positioned externally on the cartridge casing 21, such that the gain control 25 is readily accessible to the user, as shown in FIG. 2. Alternatively, the gain control 25 can also be integrated directly into the electric instrument 5. The gain control 25 can be used to overdrive the at least one vacuum tube 40 in order to generate a distorted sound. The present invention allows for an original tube-driven overdrive sound using the at least one vacuum tube 40, in a package sized to fit inside the electric instrument 5.

Figure 6:
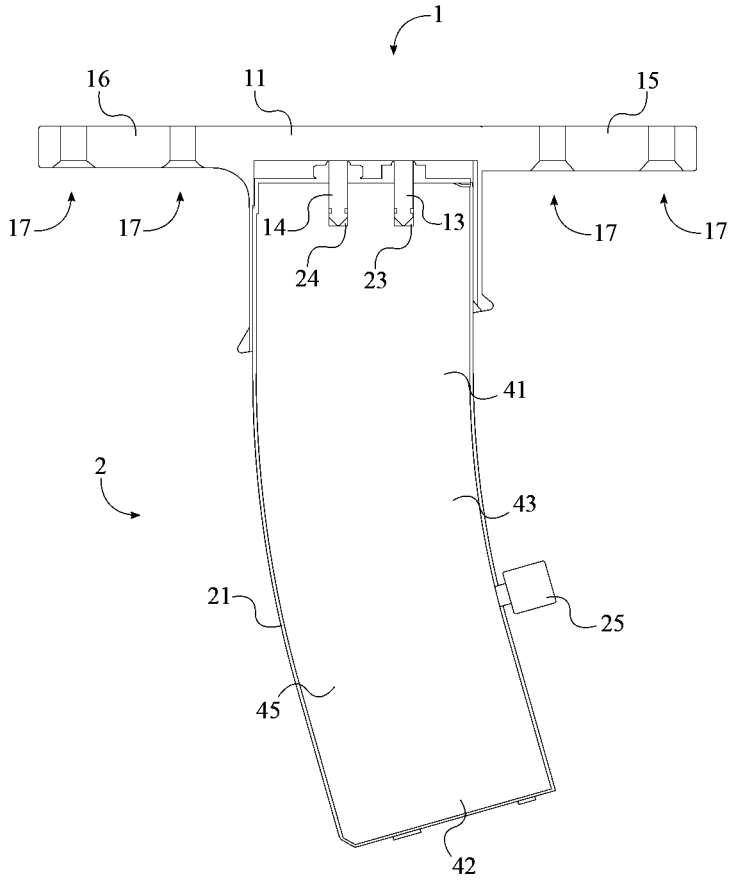
FIG. 6 is a front sectional view of the amplifier cartridge positioned within the cartridge receiver, wherein the amplification circuit includes a signal converter and a transmitter.
Figure 7:
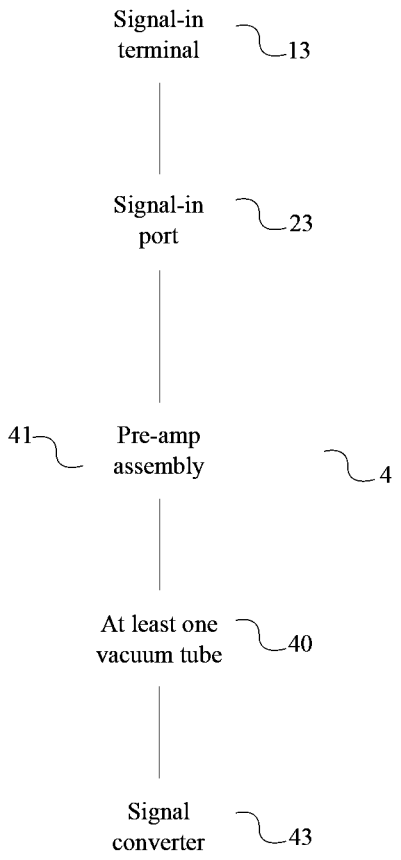
FIG. 7 is a diagram depicting the electrical connections of the amplification circuit including the signal converter.
Figure 8:
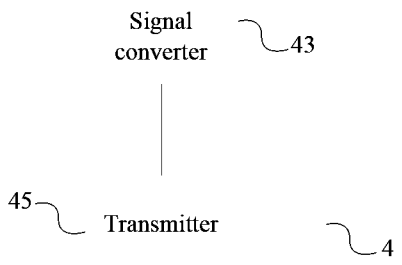
FIG. 8 is a diagram depicting the electronic connection between signal converter and the transmitter.

In reference to FIG. 6-8, in one embodiment of the present invention, the amplification circuit 4 further comprises a signal converter 43 and a transmitter 45. Once the electrical signal of the electric instrument 5 is passed through the pre-amp assembly 41 and the at least one vacuum tube 40, the signal converter 43 alters the electrical signal from an analog signal to a digital signal. The signal converter 43 alters the electrical signal into the digital signal, such that the transmitter 45 is able to transmit the digital signal to an electronic device synchronized with the transmitter 45. As such, the signal converter 43 is electrically connected to the at least one vacuum tube 40 in order to receive the electrical signal and is electronically connected to the transmitter 45 in order to relay the digital signal. The digital signal transmitted to the electronic device can then be manipulated by the synchronized electronic device. As the electrical signal of the electric instrument 5 is converted to the digital signal and transmitted to the electronic device, the electrical signal does not need to re-enter the normal path of the electric instrument 5. Therefore, the amplifier cartridge 2 does not need to comprise the signal-out port 24. The power source 42 is electrically connected to the signal converter 43 and the transmitter 45, and thus supplies current to both the signal converter 43 and the transmitter 45.

Figure 9:
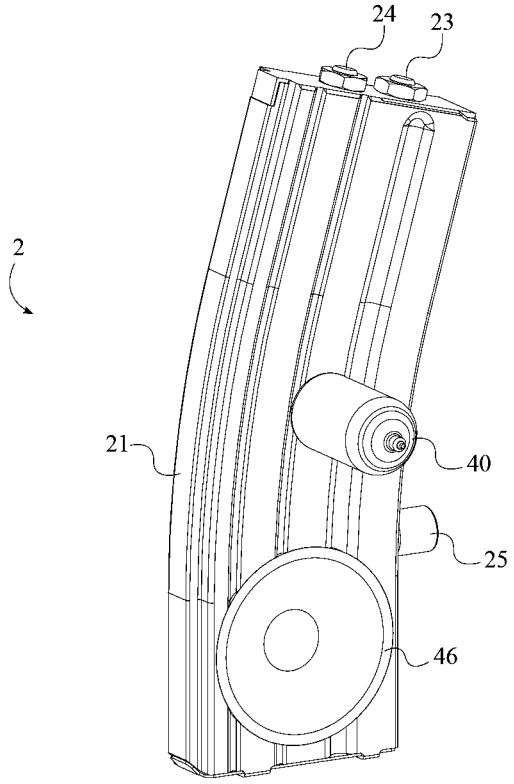
FIG. 9 is a perspective view of the amplifier cartridge, wherein the amplification circuit includes an integrated speaker positioned through the amplifier cartridge.
Figure 10:
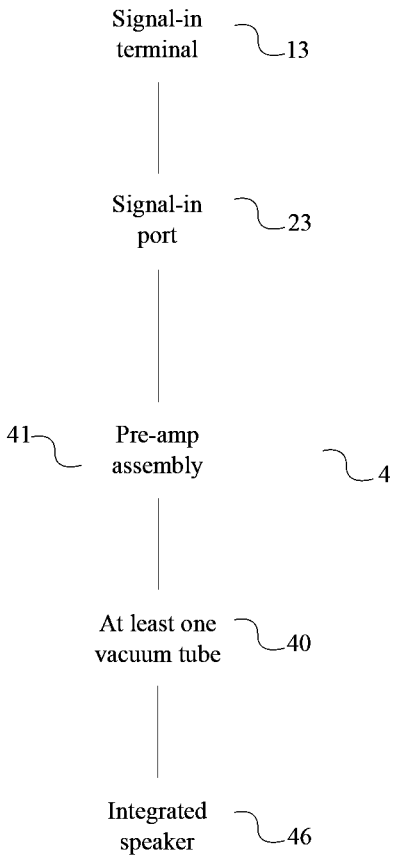
FIG. 10 is a diagram depicting the electrical connections of the amplification circuit having the integrated speaker.
Figure 16:
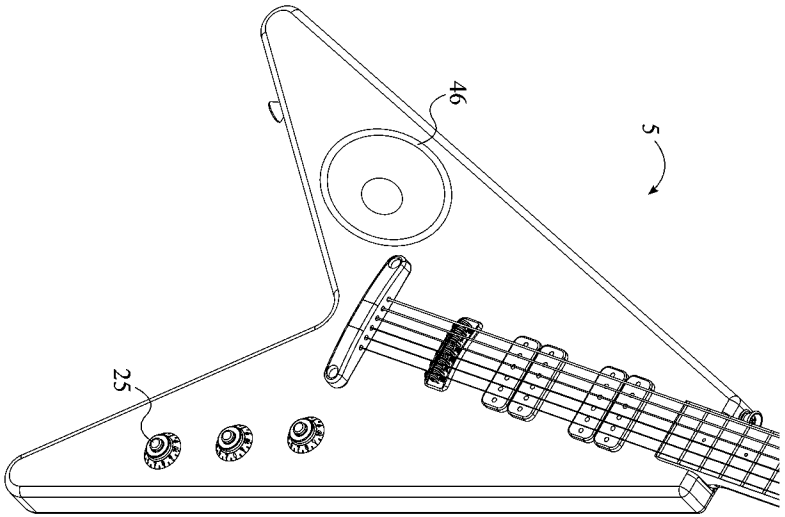
FIG. 16 is a perspective view showing the integrated speaker being positioned through the electric instrument.

In reference to FIG. 9-10 and FIG. 16, in other embodiments of the present invention, the amplification circuit 4 further comprises an integrated speaker 46. The integrated speaker 46 allows the present invention to produce sound directly from the amplifier cartridge 2 or the electric instrument 5. As such, the integrated speaker 46 is positioned through the cartridge casing 21 or the electric instrument 5, and is electrically connected to the at least one vacuum tube 40. In this way, the incoming electrical signal is amplified by both the pre-amp assembly 41 and the at least one vacuum tube 40, such that the electrical signal can be used to drive the integrated speaker 46. As the electrical signal of the electric instrument 5 is directed through the integrated speaker 46 built in to the cartridge casing 21, the electrical signal does not need to re-enter the normal path of the electric instrument 5. Therefore, the amplifier cartridge 2 does not need to comprise the signal-out port 24.

Figure 11:
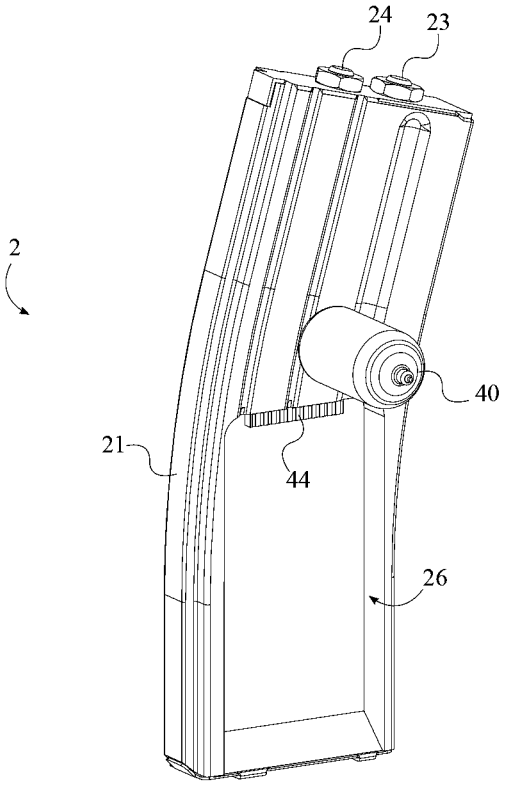
FIG. 11 is a perspective view of the amplifier cartridge having a device dock and a signal converter positioned internally.
Figure 12:
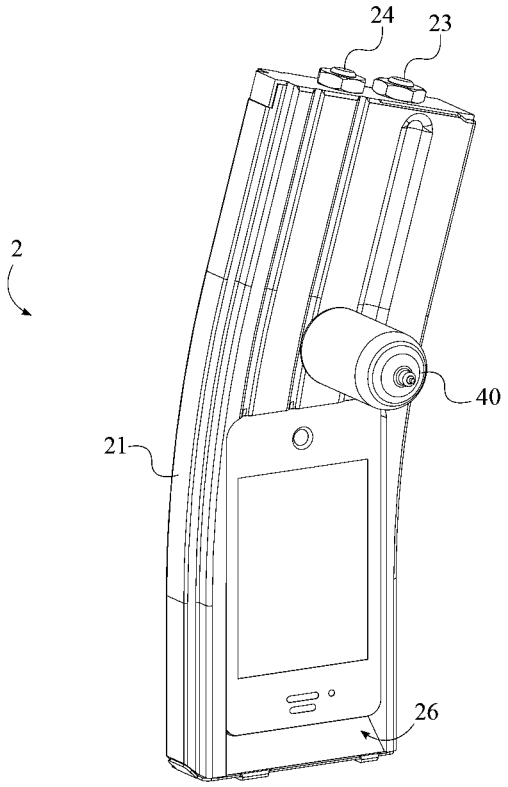
FIG. 12 is a perspective view of an electronic device positioned within the device dock, wherein the electronic device is connected to a device terminal.
Figure 13:
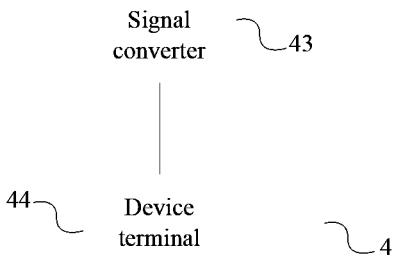
FIG. 13 is a diagram depicting the electronic connection of the signal converter and the device terminal.

In reference to FIG. 11-13, in yet another embodiment of the present invention, the amplification circuit 4 further comprises a signal converter 43 and a device terminal 44, while the amplifier cartridge 2 further comprises a device dock 26. The device dock 26 is a cavity positioned into the cartridge casing 21 that allows an electronic device, such as a mobile phone, to be attached to the amplifier cartridge 2. The device terminal 44 is connected to the cartridge casing 21 and is positioned into the device dock 26. The device terminal 44 provides an electronic connection, as well as an electrical connection, between the amplification circuit 4 and the electronic device. As such, the device terminal 44 is electronically connected to the signal converter 43, while the signal converter 43 is electrically connected to the at least one vacuum tube 40. When the electronic device is positioned within the device dock 26 and attached to the device terminal 44, the incoming electrical signal is directed through the signal converter 43 and converted to the digital signal, wherein the digital signal is then directed to the electronic device through the device terminal 44. As the electrical signal of the electric instrument 5 is converted to the digital signal and then transmitted to the electronic device, the electrical signal does not need to re-enter the normal path of the electric instrument 5. Therefore, the amplifier cartridge 2 does not need to comprise the signal-out port 24. Additionally, as the device terminal 44 is electrically connected to the amplification circuit 4, current can be supplied to the amplification circuit 4 from the electronic device, such that the power source 42 is supplemented or not needed. Additionally, the power source 42 can be used to charge or provide current to the electronic device. The electronic device can be used to apply sound effects to the electrical signal after the electrical signal has been amplified and converted, transmit the digital signal to another device, record the digital signal, etc.

Figure 17:
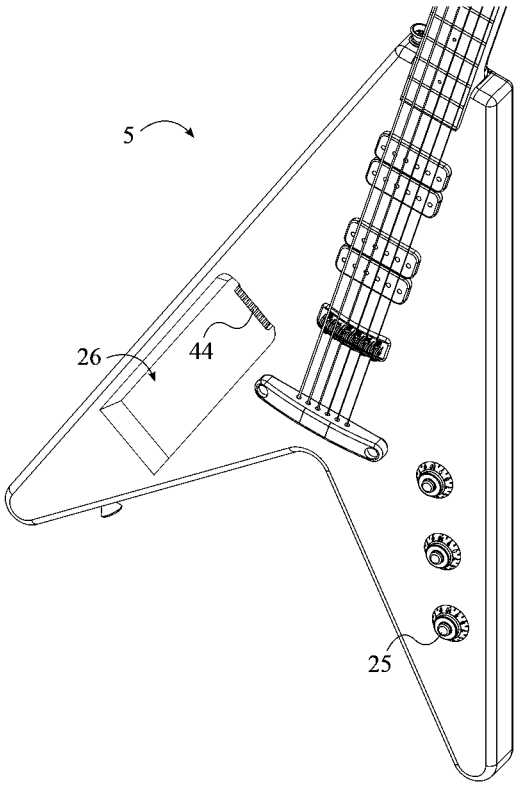
FIG. 17 is a perspective view showing the device dock positioned into the electric instrument.
Figure 18:
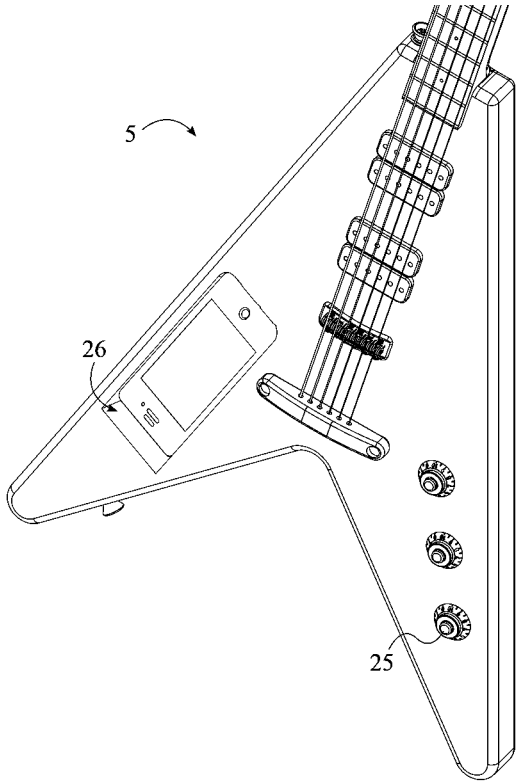
FIG. 18 is a perspective view thereof, wherein the electronic device is positioned into the device dock of the electric instrument and attached to the device terminal.

In reference to FIG. 17-18, it is also possible for the electric instrument 5 to comprise the device dock, such that the electronic device is attached to the electric instrument 5. Similar to the device dock 26 of the cartridge casing 21, the device dock 26 of the electric instrument 5 is a cavity positioned into the electric instrument 5. The device terminal 44 is connected to the electric instrument 5 and positioned into the device dock 26 of the electric instrument 5. The electronic device can then be positioned into the device dock 26 of the electric instrument 5 and attached to the device terminal 44.

Although the invention has been explained in relation to its preferred embodiment, it is to be understood that many other possible modifications and variations can be made without departing from the spirit and scope of the invention as herein described.

What is claimed is:

1. A vacuum tube amplification unit comprises:
an amplifier cartridge;
an amplification circuit;
the amplifier cartridge comprises a cartridge casing and a signal-in port;
the amplification circuit comprises an at least one vacuum tube, a pre-amp assembly, and a power source;
the signal-in port being positioned through the cartridge casing;
the signal-in port being connected to the cartridge casing;
the pre-amp assembly and the power source being positioned within the cartridge casing; and
the pre-amp assembly being electrically connected to the power source, each of the at least one vacuum tube, and the signal-in port.

2. The vacuum tube amplification unit as claimed in claim 1 comprises:
each of the at least one vacuum tube being positioned into the cartridge casing.

3. The vacuum tube amplification unit as claimed in claim 1 comprises:
the amplifier cartridge further comprises a signal-out port;
the signal-out port being positioned through the cartridge casing;
the signal-out port being connected to the cartridge casing;
the signal-out port being positioned adjacent to the signal-in port; and
the at least one vacuum tube being electrically connected to the signal-out port.

4. The vacuum tube amplification unit as claimed in claim 1 comprises:
the amplification circuit further comprises a signal converter and a transmitter;
the signal converter and the transmitter being positioned within the cartridge casing;
the signal converter being electrically connected to the at least one vacuum tube; and
the signal converter being electronically connected to the transmitter.

5. The vacuum tube amplification unit as claimed in claim 1 comprises:
the amplification circuit further comprises an integrated speaker; and
the integrated speaker being electrically connected to the at least one vacuum tube.

6. The vacuum tube amplification unit as claimed in claim 5 comprises:
the integrated speaker being positioned through the cartridge casing.

7. The vacuum tube amplification unit as claimed in claim 1 comprises:
the amplification circuit further comprises a device terminal and a signal converter;
the signal converter being electrically connected to the at least one vacuum tube; and
the signal converter being electronically connected to the device terminal.

8. The vacuum tube amplification unit as claimed in claim 7 comprises:
the amplifier cartridge further comprises a device dock;
the device dock being positioned into the cartridge casing;
the device terminal being connected to the cartridge casing;
the device terminal being positioned into the device dock; and
the signal converter being positioned within the cartridge casing.

9. The vacuum tube amplification unit as claimed in claim 1 comprises:
the amplifier cartridge further comprises a gain control;
the gain control being rotatably connected to the cartridge casing;
the gain control being externally positioned on the cartridge casing; and
the gain control being electrically connected to the pre-amp assembly.

10. The vacuum tube amplification unit as claimed in claim 1 comprises:
a cartridge receiver;
the cartridge receiver comprises a receiver body and a signal-in terminal;
the signal-in terminal being connected to the receiver body;
the amplifier cartridge being attached to the cartridge receiver;
the signal-in terminal being positioned into the signal-in port; and
the signal-in terminal being electrically connected to the signal-in port.

11. The vacuum tube amplification unit as claimed in claim 10 comprises:
the amplifier cartridge further comprises a signal-out port;
the cartridge receiver further comprises a signal-out terminal;
the signal-out terminal being connected to the receiver body;
the signal-out terminal being positioned into the signal-out port; and
the signal-out terminal being electrically connected to the signal-out port.

12. The vacuum tube amplification unit as claimed in claim 1 comprises:
a cartridge receiver;
the cartridge receiver comprises a receiver body, a receiving volume, and a signal-in terminal;
the receiving volume being positioned into the receiver body;
the signal-in terminal being positioned within the receiving volume; and
the cartridge casing being positioned into the receiving volume.

13. The vacuum tube amplification unit as claimed in claim 12 comprises:
the cartridge receiver further comprises a signal-out terminal;

the signal-out terminal being positioned adjacent to the signal-in terminal; and the signal-out terminal being positioned within the receiving volume.

14. The vacuum tube amplification unit as claimed in claim 1 comprises:

a cartridge receiver;

the cartridge receiver comprises a receiver body, a first flange, a second flange, and a plurality of holes;

the first flange and the second flange being adjacently connected to the receiver body;

the first flange and the second flange being positioned opposite each other across the receiver body;

the plurality of holes traversing through both the first flange and the second flange; and the amplifier cartridge being attached to the cartridge receiver.

15. The vacuum tube amplification unit as claimed in claim 1 comprises:

each of the at least one vacuum tube being positioned within the cartridge casing.

16. The vacuum tube amplification unit as claimed in claim 1 comprises:

an electric instrument; and the amplifier cartridge being positioned within the electric instrument.

17. The vacuum tube amplification unit as claimed in claim 16 comprises:

the amplification circuit further comprises a integrated speaker; and the integrated speaker being positioned through the electric instrument.

18. The vacuum tube amplification unit as claimed in claim 16 comprises:

the electric instrument comprises a device dock;

the amplification circuit further comprises a device terminal;

the device dock being positioned into the electric instrument the device terminal being connected to the electric instrument; and the device terminal being positioned into the device dock.

* * * * *